US007014338B2

(12) United States Patent
Pippa et al.

(10) Patent No.: US 7,014,338 B2
(45) Date of Patent: Mar. 21, 2006

(54) SPRAY BOOTH

(75) Inventors: Carlos F. Pippa, Plano, TX (US); Allan C. Day, Midland (CA); John Marcinkowski, Midhurst (CA)

(73) Assignee: Global Finishing Solutions Canada, Inc., Barrie (CA)

( * ) Notice: Subject to any disclaimer, the term of this patent is extended or adjusted under 35 U.S.C. 154(b) by 0 days.

(21) Appl. No.: 10/670,521

(22) Filed: Sep. 26, 2003

(65) Prior Publication Data

US 2005/0068774 A1 Mar. 31, 2005

(51) Int. Cl.
*B05D 1/02* (2006.01)
*F25B 29/00* (2006.01)
*F21V 33/00* (2006.01)

(52) U.S. Cl. ..... 362/253; 362/234; 454/52; 454/54; 427/424; 165/263

(58) Field of Classification Search ..... 362/227, 362/267, 234, 253; 454/50, 52, 54; 427/424; 165/263
See application file for complete search history.

(56) References Cited

U.S. PATENT DOCUMENTS 2,873,358 A * 2/1959 Dunker ..... 362/267
4,222,319 A * 9/1980 Donahue ..... 454/52
4,223,599 A * 9/1980 Napadow ..... 454/50
5,042,420 A 8/1991 Gerdes
5,147,422 A 9/1992 Neeley et al.
5,153,034 A 10/1992 Telchuk et al.
5,820,456 A 10/1998 Nelson
6,502,629 B1 * 1/2003 Valachovic ..... 165/263
6,533,654 B1 3/2003 DeRegge

FOREIGN PATENT DOCUMENTS

DE 30 42 659 A1 6/1982
DE 38 34 109 A1 4/1990

* cited by examiner

*Primary Examiner*—Thomas M. Sember
*Assistant Examiner*—James W Cranson, Jr.
(74) *Attorney, Agent, or Firm*—Blake, Cassels & Graydon LLP; Mark D. Penner

(57) ABSTRACT

A spray booth has an enclosure structure, a ventilation system and overhead lighting. An upper region of the structure defines an air inlet plenum. Air exits the inlet plenum into the work area of the booth through an array of filter elements. The resistance to airflow of the filter elements may be tuned to encourage non-uniform airflow in the workspace, and, in particular, to create a proportionately large inflow in a central region, and a flow near the walls. Part of the inflow may be located outboard of the overhead lighting assemblies, and part of the inflow may be located inboard of the lighting assemblies. The overhead lighting assemblies may be spaced apart by a distance that may be greater than the width of objects to be coated in the spray booth, and the lighting assemblies may be canted inward at an oblique angle relative to the horizontal, such that the wash of light from the spaced apart light sources may tend to be convergent.

14 Claims, 4 Drawing Sheets

SPRAY BOOTH

FIELD OF INVENTION

The invention relates generally to the field of spray booths, including paint spray booths.

BACKGROUND OF INVENTION

Coating application workspace structures, such as paint spray booths, may often be used in applying sprayed surface coatings to objects such as automobiles, or other vehicles such as aircraft, trains, trucks, buses, watercraft and so on. The purpose of applying a surface coating may tend to be both functional and aesthetic. That is, the coating may tend both (a) to protect the underlying object, whether from corrosion or abrasion, or some other environmental effect, and (b) particularly when employing a pigment, or multiple adjacent layers of different pigments, to vary the appearance of the object.

A coating, in particular a pigmented coating, may be applied to the object in a spray booth. In general, a spray apparatus may tend to emit a very fine spray of paint (or such other coating as may be applied with the sprayer), with the spray being directed by the operator in the general direction of the object to be painted. However, not all of the paint (or other spray) may necessarily encounter and wet the surface of the object to be coated. Inasmuch as the droplets in the spray vary in diameter, and inasmuch as the droplet size may be very small, a portion of the spray mist may remain suspended in the adjacent gas (typically, air) that drifts about inside the spray booth. As the cloud-like mist moves, the small droplets may coalesce and precipitate, leaving unsightly droplets, such as may tend to mar the uniformity of the surface. That is to say, if nothing further is done, it may be that suspended paint overspray may collect on the surface of the object to be coated (such as, for example, an automobile) in a manner that diminishes the quality of the surface coating.

It may be advantageous for a spray booth to have a ventilation system to urge the overspray mist, and other possible contaminants, away from the object to be coated, and, further, it may be advantageous then to purge the extracted overspray. In providing such a ventilation system, it may be desirable to filter the incoming gas, to prevent contaminants from coming into the spray booth, and to filter, or scrub, the outgoing gas to extract the overspray droplets or other suspended particles before exhausting the scrubbed gas.

It may also be advantageous to employ a relatively large volumetric flow of gas during the spraying operation. That is to say, it may be advantageous for the gas exchange rate for a booth 14 ft wide, 9 ft high, and 24 ft long to be of the order of 8,000–16,000 cfm, or more narrowly, 12,000 to 14,000 cfm, or roughly 3–4 air exchanges per minute. The general idea is to draw away the overspray before it can harm the finish. As described herein, it may also be advantageous to employ a gas flow system to aid in curing the surface coating after spray application of the coating, or one or more layers thereof, has taken place.

In one embodiment of downdraft airflow system as described herein, it is thought that differential airflow in the spray booth may be advantageous, as will be explained more fully hereinbelow. In general, it may be desirable to have the highest rate of local gas exchange most closely adjacent to surfaces upon which droplets of overspray might otherwise tend to land.

It may be advantageous to employ a spray booth that is an enclosed structure, which may be sealed. Paint may be applied to an object with a sprayer within the spray booth. In a spray painting operation, some of the paint may become suspended in the air adjacent to the object to be sprayed. A sealed spray booth may tend to discourage the suspended paint from escaping to the ambient air outside the booth. Filtered downdraft or crossdraft airflow, namely air forced to flow down and around, or across, an object and exhausted through a vent, may help in purging suspended paint. This may then tend to aid in the coating of the object, and in discouraging coalesced droplets from precipitating onto the surface of the object inappropriately.

Appropriate lighting inside the booth may tend to be helpful to aid in the application of the surface coating to the object being painted. A better lighting arrangement may provide more complete and uniform lighting, tending to reduce shadowed areas and to illuminate portions of the object that may not otherwise receive adequate lighting. It would be advantageous to have a lighting arrangement for a paint spray booth that might tend to provide enhanced lighting inside the booth, such as might bathe an object in light.

To this end, it may be advantageous to employ a generally convergent lighting system, with sources of illumination sited at a spacing distance greater than the width of the objects typically to be subject to spray coating. It may also be desirable to combine that source of illumination with a system of ventilation that may tend to urge airborne spray droplets away from the sources of illumination.

In the view of the present inventors, to the extent that a non-uniform purging gas distribution system is employed, it may also be advantageous to employ a lighting system in a manner that may tend to take advantage of the non-uniform air distribution pattern, and that may tend to dray the overspray away from the lighting to some extent. That is, it may also be advantageous to discourage overspray deposition on the lighting. Thus, a need exists for an apparatus, and a method for tailoring the purging gas (i.e., air) distribution within the booth, such as may assist in entrainment of overspray paint mist and other particulates, and advantageously to complement such a non-uniform air distribution by the placement of lighting apparatus to enhance the visibility of an operator engaged in the spray coating.

SUMMARY OF INVENTION

In a first aspect of the invention, there is a spray booth having walls and a ceiling extending therebetween, and has lighting apparatus including at least a first lighting assembly and a second lighting assembly. The first and second lighting assemblies are located adjacent the ceiling and spaced inwardly of the walls. The lighting assemblies are convergently oriented. The walls include a first wall running more closely adjacent to the first lighting assembly than any other wall, and an opposed wall running more closely adjacent to the second lighting assembly than any other wall. The spray booth has a ventilation system that includes venting mounted between the first lighting assembly and the first wall. In another feature, the ventilation system includes venting mounted between the second lighting assembly and the second wall. In still another feature, the ventilation system includes venting mounted between the first and second lighting assemblies.

In a further feature, the spray booth has a floor opposed to the ceiling and the walls stand upwardly of the floor. The ventilation system includes inlet venting nearer to the ceiling than the floor and outlet venting nearer to the floor than the ceiling. In yet a further feature, the spray booth has a floor opposed to the ceiling and the walls stand upwardly of the floor. The ventilation system includes outlet venting nearer to the ceiling than the floor, and inlet venting nearer to the floor than the ceiling.

In another aspect of the invention, there is a spray booth having walls and a ceiling extending therebetween, and has lighting apparatus including at least a first lighting assembly and a second lighting assembly. The first and second lighting assemblies are located adjacent the ceiling and spaced inwardly of the walls. The lighting assemblies are convergently oriented. The walls include a first wall running more closely adjacent to the first lighting assembly than any other wall, and an opposed wall running more closely adjacent to the second lighting assembly than any other wall. The spray booth has a ventilation system that includes inlet venting mounted between the first lighting assembly and the first wall, between the second lighting assembly and the second wall, and between the first lighting assembly and the second lighting assembly, and exhaust venting is mounted distant from the ceiling.

In a further aspect of the invention, there is a spray booth having walls and a ceiling extending therebetween, and has lighting apparatus including at least a first lighting assembly and a second lighting assembly. The first and second lighting assemblies are located adjacent the ceiling and spaced inwardly of the walls. The lighting assemblies are convergently oriented. The spray booth has a ventilation system operable to urge overspray away from the lighting system.

In a still further aspect of the invention, there is a spray booth having walls and a ceiling extending therebetween, and has lighting apparatus including at least a first lighting assembly and a second lighting assembly. The first and second lighting assemblies are located adjacent the ceiling and spaced inwardly of the walls. The lighting assemblies are convergently oriented. The spray booth has a ventilation system that includes inlet vents mounted in a straddling arrangement relative to the lighting apparatus, and outlet vents mounted distant from the ceiling. The ventilation system is operable to introduce ventilating gas into the spray booth adjacent the lighting apparatus, and to urge ventilating gas introduced adjacent the lighting apparatus to move toward the outlet vents. In a further feature, the ventilation system includes vents mounted between the first and second lighting apparatus.

In still a further feature, the paint booth has a central floor region on which to rest objects to be painted. The floor region has a footprint. The footprint has a length and a width. The first lighting apparatus has a length oriented to run generally lengthwise relative to the length of the footprint. The second lighting apparatus has a length oriented to run generally lengthwise relative to the length of the footprint.

In yet a further feature, the first and second lighting assemblies have respective lengthwise centerlines. The lengthwise centerlines are spaced apart a distance greater than the width of the footprint. In still yet a further feature, the first and second lighting assemblies are symmetrically mounted relative to the footprint.

In a still further aspect of the invention, there is a spray booth having walls and a ceiling extending therebetween, and has lighting apparatus including at least a first lighting assembly and a second lighting assembly. The first and second lighting assemblies are located adjacent the ceiling and spaced inwardly of the walls. The lighting assemblies are convergently oriented. When viewed in a cross-section across the spray booth, the first lighting apparatus emits light at a maximum intensity along a first vector. The second lighting apparatus emits light at a maximum intensity along a second vector, and the first and second vectors intersect. In still another feature, the vectors intersect at a height greater than floor level.

In other aspects the invention provides various combinations and subsets of the aspects described above.

BRIEF DESCRIPTION OF DRAWINGS

For the purposes of description, but not of limitation, the foregoing and other aspects of the invention are explained in greater detail with reference to the accompanying drawings, in which.

DETAILED DESCRIPTION OF THE INVENTION

Figure 1A:
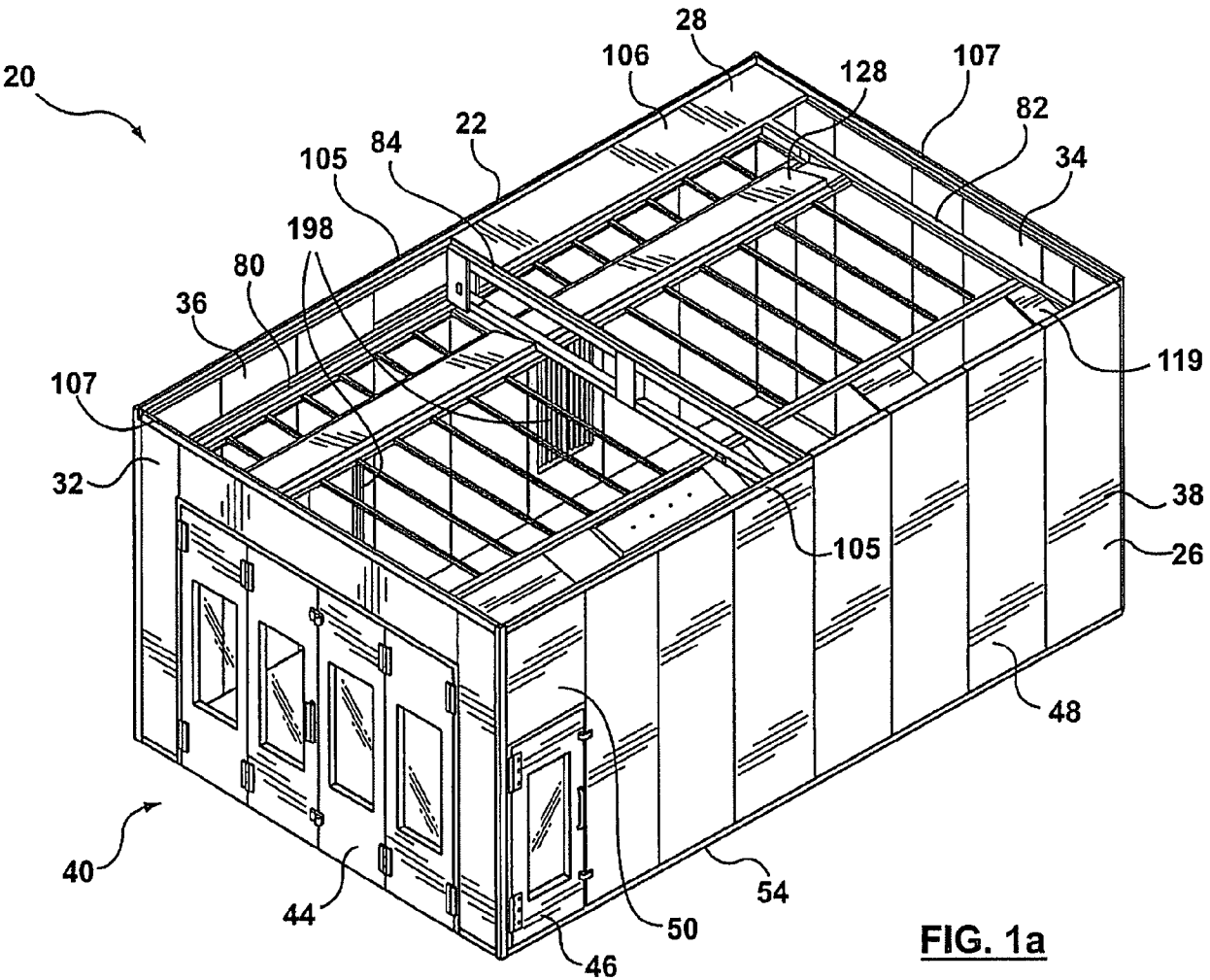
FIG. 1*a* is an exterior isometric view of a spray booth in accordance with an embodiment of the present invention with portions of the roof removed.

The description that follows is provided by way of illustration of an example, or examples, of particular embodiments of the principles of the present invention. These examples are provided for the purposes of explanation, and not limitation, of those principles and of the invention. In the description which follows, like parts are marked throughout the specification and the drawings with the same respective reference numerals.

In the description reference may be made to the general environment of the invention. A booth for applying coatings such as a paint spray booth may generally have a bottom, base or floor, and a top, roof or ceiling spaced some distance upwardly of the floor. The booth may tend to have walls extending vertically between the floor and the ceiling. In the instance of a booth for painting, or coating, an object that is brought in on a conveyor line, or, such as a piece of transportation equipment that is introduced along a track or pathway, the door by which the workpiece object is introduced may be termed the front door, and may be mounted in the front wall, if there is such a wall, and the opposite wall may have an exit door. That opposite wall would then be the rear wall. Similarly, the walls that run alongside the path of transport of the workpiece may be termed side walls, as opposed to front and back, and may be left side and right side walls. The choice of the terms front, rear, left, right, and so on, is arbitrary. Generally speaking, unless stated otherwise, transverse is crosswise relative to the paint booth and to the path of the workpiece object in the paint booth, and lengthwise refers to an orientation along the path or footprint of the object.

By way of a general overview, FIG. 1 shows a simplified view of an enclosure or housing in which to apply a surface coating to an object by way of directing a stream of coating particles toward the object, that enclosure being identified as a spray booth 20 in accordance with an embodiment of the present invention. Spray booth 20 may be a paint spray booth, and may be used for applying protective external coatings to manufactured objects, including transportation objects such as rail road cars, locomotives, buses, trucks, aircraft, and most particularly, automobiles.

Figure 1B:
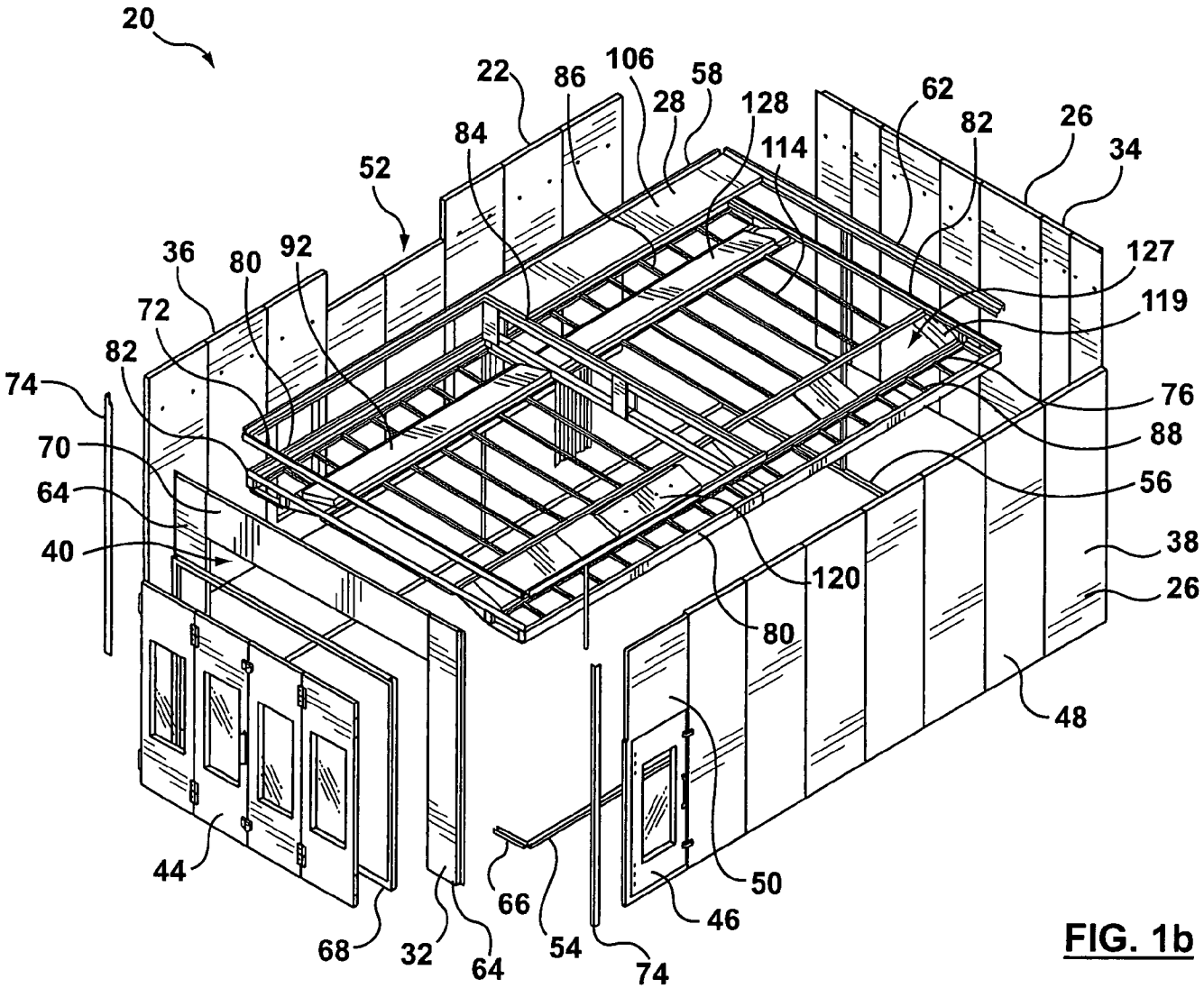
FIG. 1*b* shows an exploded view of the spray booth of FIG. 1*a;*
Figure 2:
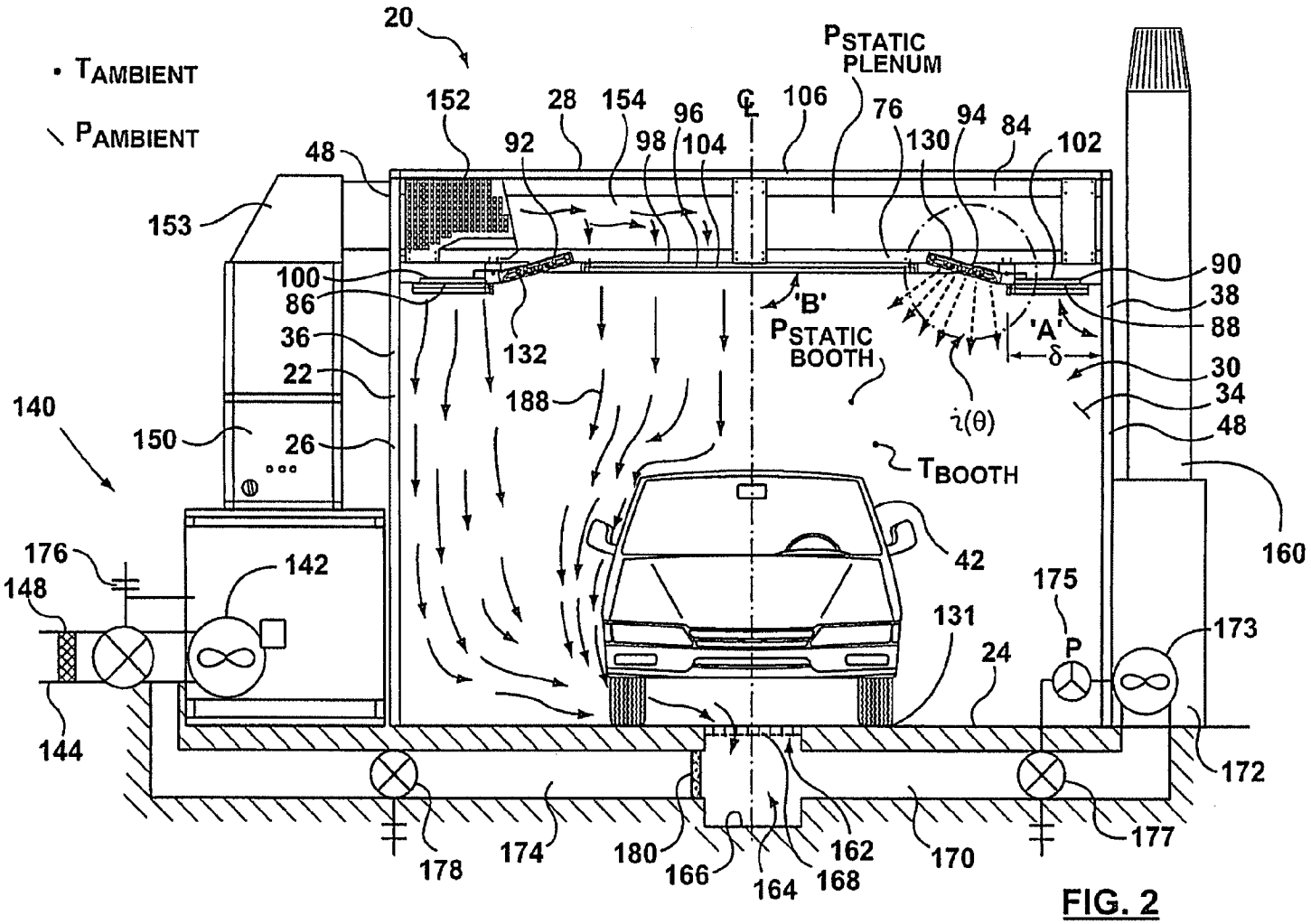
FIG. 2 is an end view, in partial section, showing a general arrangement of components of the spray booth assembly of FIG. 1.

Spray booth 20 has an enclosure structure, indicated generally as 22 that sits on a base, indicated generally as 24. Base 24 may be outside, or inside another, larger structure and may be a paved surface, tiles, or a concrete pad, such as may be smooth, relatively easy to seal, and clean. Base 24 may also have channels formed therein, for accommodating utility conduits such as airflow ducts. Enclosure structure 22 includes a wall section 26 and a roof structure 28. As shown in FIG. 2, wall section 26 and roof structure 28 co-operate to enclose an interior space, indicated generally as 30. There is a large number of possible variations of arrangement of structure for spray booth 20 to enclose interior space 30. For example, as shown in FIG. 1, wall section 26 may include a front wall 32, a rear wall 34, and left and right hand side walls 36, 38 adjoining front wall 32 and rear wall 34 co-operatively to form a generally rectangular, or square enclosure about interior space 30. Front wall 32 may include an opening, or entrance, such as is that indicated in FIG. 1*a* and FIG. 1*b* as doorway 40, by which to allow objects to be painted, such as a vehicle 42, to enter or exit booth 20. Conveniently, front doors 44 are provided, and are operable to control access to spray booth 20 through doorway 40. One side wall, such as side wall 38 may include a personnel door 46, allowing a technician to enter or exit spray booth 20.

Spray booth 20 may be built to accommodate objects of varying sizes for coating. For coating smaller objects, a reduced-sized booth may be built. For coating larger objects such as a truck, aircraft or rail road rolling stock, a larger booth may be more desirable. Spray booth 20 may be used for applying paint, or may be a spray booth for applying other types of sprayed coatings. In the business of surface coatings for transportation equipment such as aircraft, rail road rolling stock, and most especially automobiles, a booth such as spray booth 20, may be provided in a modular form. That is, side walls 36, 38 are assembled from a number of pre-fabricated wall panels, 48, of uniform construction that mate together to form a wall, or that can be mounted to surmount each other to form an enclosure of double or triple height. Where a longer bay is required, additional panels 48 may be added. That is, where, for example, a standard one unit bay may have a length equal to about 24 ft, being the width of 8 wall panels of 3 feet width, an extended length booth may have a length of 27 ft or 30 ft. and so on, as the next increments. In the case of a drive-through, or high production volume paint booth, three "single" booths 24 ft long may be joined end-to-end to make a 72 ft booth with doors at each end. Many combinations are possible. Other prefabricated door panels, such as panel 50, may include pre-fabricated, reasonably well-sealed door 46. End walls, such as rear wall 34, may also be made of a plurality of pre-fabricated wall panels of a uniform width, combined to give, in one embodiment, an internal width of about 14 or 15 feet. Similarly, doors 44 may be pre-fabricated, reasonably tight-sealing folding doors. It may be noted that walls 34, 36, 38 and roof structure 28 may be "single skin" (i.e., uninsulated) or double skin (i.e., insulated) panels and may be of constant through-thickness. The insulated panels may tend to be employed where curing with the assistance of a heating element is employed. Booth 22 may be erected outside, or it may be erected inside, or on the margin of, a larger building, such as a manufacturing bay of a larger factory, or a paint bay of a repair facility, and so on. Some of the panels of side wall 36 may be of a shorter length than their neighbours, to yield, when assembled, a rectangular cut-out, or port, indicated generally as 52, for accommodating ducting of a ventilation system, 140, more fully described below.

The lower margins of wall panels 48 seat along a sidewall panel rail, channel, or angle that is identified as side wall levelling rail 54, which is mounted to the underlying floor structure, namely base 24. Similarly the panels of rear end wall 34 seat on an end wall panel rail, channel, or angle, identified as a rear panel levelling rail 56, that is, again, mounted to base 24. The upper margins of sidewall panels 48 (and 50) are tied together by a top rail, channel, or angle identified as side wall roof support rail 58, and the upper margins of the panels of rear end wall 34 are tied together with an end wall rail or channel, or angle, identified as end wall roof panel support rail 62. The construction of front wall 32 includes a pair of side margin panels 64 mounted in levelling rails 66, a door frame 68, and the assembly of close fitting doors 44, and a plenum header panel, 70 that seats upon door frame 68. The entire assembly is tied together along its upper margin by a front wall roof support rail identified as 72. Corner rail, or angles, or corner covers 74 link the upright vertices of the front wall and sidewalls, and the rear wall and sidewalls.

The construction of the ceiling assembly 76, and the roof structure 28 may now be considered. Longitudinally running ceiling support side beams 80 are mounted to the respective inwardly oriented faces of side walls 36 and 38 at a height that is to be comfortably vertically clear of the objects to be coated in booth 20. This provides a third, intermediate, longitudinal reinforcement element for tying sidewall panels 48 together, and for providing a vertical structural loads transfer interface between the elements of ceiling assembly 76 and side walls 36, 38. For a double-height booth, this height may be of the order of 20 ft or more. For a single height booth this height may be of the order of 6 to 10 feet, may be in the range of 8 to 10 ft, and, in one embodiment, may be about 9 ft (+/−6 inches). A laterally, or transversely, running beam 82 is mounted to run across the inwardly oriented face of rear end wall 34, at a height corresponding to the height of beam 80, and, again, may serve to provide a third, intermediate height reinforcement tying the end wall panels together, and for providing a vertical load transfer interface between elements of the ceiling assembly and rear end wall 34. A similar front wall transverse beam member is mounted to the inwardly oriented face of front wall 32, again at the corresponding height, to yield a four sided rectangular rail support structure at the desired ceiling height.

Where booth 20 is of modest length, such as 24 ft, a single intermediate ceiling reinforcement cross beam 84 may be employed, with 12 ft sections of longitudinal filter and light framing being supported between the front and rear end walls 32, 34 and cross beam 84, respectively. For longer spray booths, more cross-beams 84 may be used, on relatively equal spacing, as may be suitable. Cross-beam 84 may have an upper compression member, a lower, tension member, and gussets or other shear transfer elements. Upstanding vertical posts or column members may be mounted beneath the ends of cross beam 84 to carry vertical loads into base 24. Roofing, such as may also be formed from a plurality of assembled parallel pre-fabricated panels 106, overlie the upper margins of the side wall and front and rear wall panels and the upper, or compression, member of beam (or beams, as may be) 84, forming a sealed structure.

The ceiling support rails noted above, and cross beam 84 (and, in particular, the lower, tension member thereof) support the remainder of the ceiling assembly, namely left and right hand filter frames 86, 88, and the associated filter elements 90 mounted in them, left and right hand lighting assemblies 92, 94, and central filter frame assemblies 96, and their associated filter elements, 98. Filter elements 90 cooperate to define outboard filter element arrays 100 and 102. Filter elements 98 co-operate to define central filter element array 104.

As shown in part in FIG. 1*a*, roof structure 28 includes an array of prefabricated roof panels 106, laid side by side and supported by the peripheral rails 105, 107 mounted along the upper margins of walls 32, 34, 36, and 38, and the upper cross member of cross beam 84 to cover completely the periphery of wall section 26. Roof panels 106 are joined together to form a sealed structure.

The construction of the filter arrays may be as follows. First, transverse structural support members, namely rails 82 extend along the inner faces of the upper regions front wall 32 and rear wall 34. Rails 82 may be substantially straight, and may run substantially horizontally between walls 36 and 38. In one embodiment rails 82 may be approximately 14 ft long. Vertical hanger brackets 108 are mounted to, and extend downwardly from, rails 82. Brackets 108 are spaced a distance δ laterally inboard from side walls 36 and 38. That distance δ, may be in the order of 1/25 to 1/5 of the length of rails 82, and may in one embodiment be in the range of 1/20 to 1/10 of the length of rail 82, and in another embodiment may be in the range of 3 to 30 inches, and in another embodiment may be in the range of 6 to 18 inches, and, in another embodiment may be about 12 inches, (+/−3 inches). The longitudinally extending elements, namely filter frames 86 and 88, and left and right hand lighting assemblies 92 and 94 are mounted between the lower extremities of brackets 108 on front and rear walls 32 and 34 respectively. Further brackets 108 are located adjacent side rails 80.

The outboard edge of each of the respective filter frames of the outboard filter assemblies, namely outboard filter element arrays 100, 102, pick up on, and are hingedly mounted to, the side rail members, namely beams 80. The inboard edge of each of the outboard filter frame assemblies 86, 88 pick up on, and are latchingly mounted to, the outboard flanges 110 of the respective left and right hand lighting assemblies 92 and 94. The frame assemblies may define filter accommodations, or pivotally hinged filter carriers 112, that may be used to accommodate, and support outboard filter array elements 90. Carriers 112 may be hinged to swing downwardly to permit the members of filter array element 90 to be replaced as may be required. The pivoting motion on the hinge between the latched position and a service access position for replacing filter elements is symbolised by arrow 'A' in FIGS. 2 and 3. In one embodiment there are eight equally sized filter array elements 90 (and their respective carriers 112) between front wall 32 and central cross beam member 84. Unequal sizes may also be used.

Similarly, the outboard edges of each of the respective inboard or central filter frames 114 of the inboard, or central, filter frame assemblies 96 pick up on, and may be mounted to, the inboard flanges 116 of left and right hand lighting assemblies 92, 94, one embodiment being hinged on one side, and latched on the other. Frames 114 may then define hinged filter carriers 118 such as may be used to support central, or inboard filter array elements 98. Carriers 118 are hinged to swing downwardly (as indicated symbolically by arrow "B" in FIG. 2) and to permit the members of filter element array 104 to be replaced as required. In one embodiment there may be eight equally sized filter array elements 98 (and their respective carriers 118) in a parallel strip arrangement between front wall 32 and the central cross beam (namely intermediate ceiling reinforcement beam 84), and between the central cross beam (namely intermediate ceiling reinforcement beam 84) and rear wall 34. In each case, the inboard and outboard filter frames are made of bars connected to form rectangular accommodations for the carriers and filter elements. The bars may be light gauge angle iron or channels. The filter elements themselves are described below.

When viewed from above or below, overhead lighting assembly 92 or 94 has a generally narrow rectangular shape, having two long sides, namely the outboard edge and the inboard edge, and two short ends. Overhead lighting assembly 92 or 94 is oriented such that its long sides are substantially horizontal and parallel with side walls 36, or 38 (as may be) Its outer edge is positioned lower than inner edge in its installed position. As such, overhead lighting assembly 92, 94 is oriented at an oblique angle α relative to the horizontal plane H (see FIG. 3). At the short end of overhead lighting assembly 92 or 94, a region adjacent the inner edge may be joined to plenum center beam 84 or plenum end beam 82. A region adjacent the outer edge may be joined to plenum center beam 84 or plenum end beam 82 through hanger 108.

Longitudinally running lighting assemblies 92, 94 such as may have a generally flat configuration when viewed from above may include formed web sections 119 and longitudinally periodically spaced formed backshells 120 for accommodating illumination element arrays. Web sections 119 have inboard and outboard margins formed into flanges 110, 116 of complex shape for engaging the adjacent inboard filter element array 104 and outboard filter element arrays 100, 102. That is, the outboard flange 110 may have a downwardly extending leg 121 that is folded back on itself, and a horizontal leg that extends distally to terminate at an upturned lip 123. The double folded, downwardly extending 121 leg then may form the side of a door jamb, against which to engage a latch of the hinged filter frame. The distal, horizontal leg may provide a land 125 against which the filter frame 86 or 88, may be permanently mated, and against which the filter carrier 112 may seat and latch in place. Inbound flange 116 may be similar, but angled to mate with inbound filter frame 114. Web sections 119 also have openings 127 formed in them, such as may be formed by stamping, and such as may be generally rectangular to correspond to the footprint of periodically spaced backshells 120. Backshells 120 may have a back portion 122 that may have a truncated rectangular inverted flat-bottomed trough shape, which seats on web sheet 119, centered on an opening 127. Electrical sockets may be mounted in backshell 120 for accommodating illumination elements. This channel section may be relatively deep, and may tend to function as a support beam running longitudinally between the front wall 32, and central cross beam 84; and between rear wall 34 and central cross beam 84. Lighting assemblies 92, 94 may also have longitudinally running back covers 128 mounted to web section 119 overspanning back shells 120.

When viewed in cross-section, back portion 122 of backshell 120 may have a generally planar portion that may be oriented at an angle α with respect to the horizontal. As such, when installed, the root of inboard flange 116 may tend to be located at a greater elevation (relative to base 24) than the root of outboard flange 110. Where the planar distal portion of flanges 110 and 116 are both horizontal, they will then tend to lie in parallel planes, one stepped upwardly relative to the other. It follows from this that booth 20 may then have a stepped ceiling assembly, in which one portion, such as the outboard filter array 100, or 102 is stepped downward relative to another portion, such as central filter array 104, with one portion lying outboard of the lighting assembly, and another portion lying inboard of the lighting assembly (be it 92 or 94).

Spray booth 20 has a vertical centre plane indicated by the symbol CL that is centred between side walls 36, 38. Overhead light panels assemblies 92 and 94 may be positioned symmetrically about this vertical centre plane. As both overhead light panels assemblies 92, 94 are oriented, or angled toward this vertical centre plane CL, the light emitted may tend to converge towards the vertical centre plane. Vehicle 42, when positioned in spray chamber 30, preferably has its centre line generally lying in or adjacent to the vertical centre plane. In one embodiment, base 24 of spray booth 20 may have a footprint 131 or footprint region, defining a pathway for vehicles to be sprayed. Footprint 131 may straddle exhaust pit 166 described below, and, in the case of automobiles may define a path about 4 ft to 8 ft wide, located symmetrically about the centre plane CL.

An array of light emitting elements 130 is mounted within each backshell 120. Light emitting elements 130 may be incandescent lighting bulbs, fluorescent lighting elements, LEDs, or such other light sources as may be suitable. A translucent cover member 132 is mounted at the mouth of backshell 120. Translucent cover member 132 may be made of clear glass, or a clear plastic material, or may be a glass or plastic member of a pebbled, or "frosted" surface to yield a more diffuse light in operation. Translucent cover member 132 may be oriented at an angle $\beta$ with respect to the horizontal. Backshell back portion 122 and cover member 132 may lie in parallel planes, such that $\alpha$ and $\beta$ are the same. Backshell 120 may tend to be reflective, and may have a white or shiny surface finish 134, the better to reflect radiation in the visible range outwardly toward the object to be coated. $\alpha$ and $\beta$ may lie in the range of 5 to 30°, and in one embodiment is in the range of 10° to 15° and may, specifically, be about 13°.

In operation, lighting assemblies 92, 94 may tend to emit a flux of light through cover member 132. The intensity i of this flux, may tend to vary across cover 132 as a function of angle, symbolised by angle $\theta$, measured from the longitudinal axial centreline of cover 132. The direction of greatest flux, as a function of $\theta$, and symbolized by the function i ($\theta$, r), may tend to be in a direction generally normal, (i.e., perpendicular) to the outer surface of cover 132. The direction of the light flux emission of greatest intensity of the opposed left and right hand lighting assemblies 92, 94 (running along vectors lying at angle $\theta$, relative to the vertical) converge. That is to say, assemblies 92, 94 are oriented to be convergent light sources. The relationship of flux to variable r, namely the radial distance in the $\theta$ direction, may tend to be inverse such that as r increases the flux may tend to decrease.

Booth 20 has a ventilation system 140 that is operable to introduce a flushing, or purging transport medium, in the nature of a transport gas, such as may be air, through which the coating, such as paint, may be sprayed toward the object, with the general purpose of directing a fine spray, or mist of fine droplets or particles of the coating material toward the workpiece object. By the nature of finely dispersed spray particles such as may be used in a variety of coating processes, overspray may tend to remain in suspension in the gas medium in which the workpiece object has been positioned during the coating application process. It may be desirable to remove, which is to say extract, the overspray, and, where the spray is being applied by a human operator, as when paint spray booth 20 is an auto repair paint spray booth (as opposed to an automated production line) to provide clean, fresh air for the operator.

To that end, ventilation system 140 includes an air moving device, such as may be an inlet fan, identified as centrifugal blower 142, mounted adjacent to wall 36 of booth 20, and having inlet ducting 144 through which to draw in fresh air, blower 142 being operable to force air into interior space 30. Inlet ducting 144 may include a first stage of filtering 148 such as may tend to exclude dust, dirt and other particulate matter. Filtering 148 may be located either upstream or downstream of blower 142. Blower 142 may feed a heater element 150, for use in encouraging, or hastening, the curing of such spray coating as may be applied in booth 20. Ducting 153 from blower 142, and heater element 150, if employed, may lead to a diffuser member 152 located above ceiling assembly 76 and below roof panels 106. Inasmuch as roof panels 106 are connected together in a sealed manner, and the upper ends of wall panels 48 are sealed and form a continuous rectangular periphery about roof panels 106, and inasmuch as the members of inboard filtering array 104, outboard filtering arrays 100, 102 and lighting apparatus 92, 94 present resistance to airflow, the space so surrounded defines a plenum 154, which functions as an inlet manifold, as is more fully described below.

Ventilation system 140 also includes air inlet plenum, 154, connected in fluid communication with, and fed by, blower 142. An array of filtering media, namely elements 90 and 98, may be provided as described above to encourage exclusion of dust dirt, and other particulate matter whose presence may not be advantageous in achieving a desired high quality finish external coating. Inlet ducting 153 may typically end at an expanding fluid flow conduit, such as diffuser member 152, in which the cross sectional area of the inlet flow may tend to increase, while the inlet flow velocity may tend to decrease. Inlet plenum 154 may have a plurality of outlets namely through the elements 90 and 98 of the filter arrays (and may, therefore, quite properly be considered to be an inlet manifold). Those outlets give onto the interior of paint booth 20 more generally, as discussed more fully below.

Ventilation system 140 may also include an exhaust assembly, such as is indicated generally as 160. Exhaust assembly 160 may include vents in the nature of outlet, exit, or exhaust ports 162, arranged in an array about a lower region of spray booth 20, for example at the level of base boards, in common fluid communication with an exhaust manifold, such as is identified as outlet plenum 164. For example, in booth 20 outlet plenum 164 may have the form of a longitudinally extending trench, or pit 166, covered by a gas permeable grille 168. Ducting 170 is then ported onto pit 166, either longitudinally or transversely. Ducting 170 may be overlain by concrete of the flooring of booth 20, and is used to extract air from booth 20.

Outlet plenum 164 may be connected by ducting 170 in turn to a scrubber 172. Extracted particulate laden purging gas, (generally speaking, air) from the spray booth enclosure, is directed through scrubber 172, and the scrubbed remainder may then be exhausted to ambient. A blower 173 may be employed to draw air along ducting 170. Blower 173 may co-operate with a pressure differential control apparatus 175 such as may include a valve or damper 177. Movement of damper 177 may tend to alter the resistance of the exhaust assembly generally, and thereby permit the operator to vary the pressure difference between the static pressure inside booth 20 and the external ambient static pressure, thereby permitting maintenance of a small positive pressure in booth 20, such as may be in the range of neutral (i.e., balanced pressure inside and outside, 0 inches of water pressure difference) and about ¼ inches of water. Many possible extracting, scrubbing, and settling systems are possible, and may include systems in which the scrubbing element is a water curtain located upstream of a settling element (such as a cyclone), or a secondary blower, such as a centrifugal blower having an exhaust stack of a length greater than the height of booth 20, and such as may be taller than the building structure in which booth 20 is erected. Ventilation system 140 may be used to provide downdraft airflow. Spray booth 20 may have either downdraft air flow or a crossdraft air flow.

Ventilation system 140 may also include a recirculation line 174 having an inlet tapped into pit 166, and an outlet tapped into inlet ducting 144 of blower 142. Inlet ducting 144 may optionally have a variable position valve or damper 176 whose position may be set manually or may be set automatically depending on the regime in which booth 20 is to be operated. Recirculation line 174 may, optionally, have a damper 178 which may be a fully controlled valve that is either manually or automatically driven to a desired setting (similar to damper 176). A filter 180 for removing particulate matter may be installed in recirculation line 174 (alternatively, recirculation line 174 can be teed into inlet line 144 upstream of filter 148).

When outlet damper 117 is moved to a closed position, blower 142 may tend to draw from recirculation line 174, rather than inlet ducting 144. In all cases, assuming leakage through the walls of booth 20 to be quite small relative to the overall flows, the flow rate out through exhaust ducting 170 is roughly equal to the inflow rate through inlet duct 144.

During painting, damper 117 (and damper 176 if employed) is (or are) in a fully open position, and hence inlet duct 144 is wide open. Damper 178 (if employed) is closed, such that there is no recirculation flow. Even if damper 178 is not employed, extraction by blower 173 may tend to draw off as much air as is introduced at the inlet duct, thus tending to yield little or no flow through the recirculation system. During curing, there is no paint spray to be drawn into the recirculation system (and hence into blower 142), so damper 177 may be moved to an intermediate position, such as 90% closed, and damper 178 (if employed) moves, (or is moved, if actively controlled) to a fully open position such that the airflow through blower 142 may be about 90% recirc and 10% fresh. To the extent that inlet blower 142 is operating, and the outlet is choked by damper 177, air may tend to be recirculated through the recirculation system, yielding a ratio of fresh air to recirc air. Varying the positions of damper 177 to intermediate positions may permit this ratio to be altered as may be suitable, possibly in the range of 1 recirc: 1 fresh to 20 recirc: 1 fresh. During curing, heater element 150 may be used to heat the air as it circulates, and thereby to accelerate curing. Heater element 150 may also be used during painting partially to warm fresh inlet air to room temperature (roughly 70–75 F). Damper 176 may tend to be employed where there is high resistance in the exhaust system, and balancing is required.

During spray operation, with the recirc system closed, the airflow from blower 142 may be in the range of 8,000 to 12,000 cfm for a 24 ft long booth that is 14 ft wide and 9 ft high to the ceiling, with a 2 ft ceiling plenum giving an overall height of 11 ft. This may tend to yield an air exchange rate in the range of about 2 ½ to 4 air changes per minute. In general, booth 20 may tend to be operated slightly above ambient pressure ($P_{ambient}$) so that, if anything, air may tend to leak through the wall, roof seams and door seals outwardly of booth 20, rather than inwardly, thereby tending to exclude dust or other contaminants. The pressure difference may perhaps be of the order of 0 (neutral) to about ¼ inches of water gauge between $P_{static\ booth}$ and $P_{ambient}$. This may be contrasted to be a pressure increase of up to about 3 inches of water across blower 142.

To the extent that the inboard and outboard ceiling panel filtering array elements present resistance to airflow, there may tend to be an approximately uniform static pressure $P_{static\ booth}$ in celing plenum 154 that is higher than the approximately uniform static pressure $P_{static\ booth}$ in the lower, or main portion of the enclosed space of booth 20 more generally. Given this pressure drop ΔP, by varying the resistance of the filter array elements in the ceiling assembly, the airflow may be biased toward (or away from) one region or another of interior space 26 of booth 20.

For example, it may be desired to discourage deposition of overspray mist droplets on either the workpiece surface or the side walls (and, to a lesser extent, the floor) surfaces of booth 20. Where a flow of fluid it directed along a surface, the flow may tend to "attach" to that surface, and follow its contour. In such a situation, the flow velocity of the fluid may tend to be relatively great relatively close to the surface, and may fall off at greater distances from the surface. This enhanced velocity adjacent to the surface may tend to carry away potential contaminants, such as overspray mist droplets, perhaps more aggressively than a slower stream, and may tend thereby to reduce the tendency of the droplets to precipitate onto the surface of the object to be coated.

To that end, it may be desired to release the greater proportion of the volumetric flow from plenum 154 through the central regions thereof, thus encouraging the formation of flows that may have locally enhanced velocity, and may have a tendency to follow the contour of the object to be sprayed. Where the outlet pressure sink is defined by the longitudinally extending pit 166, the tendency of the flow to follow the contour of the object to a relatively low level with delayed or diminished flow separation, may be enhanced. Similarly, to the extent that it may be desirable to discourage precipitation of spray droplets on the walls, the outer regions of the filter array elements 90 lying adjacent to the upper margins of wall panels 36, 38, may also be relatively permeable as compared to the respective sheet metal backshells of lighting assemblies 92, 94, though perhaps less readily permeable to airflow, per unit of area, than inboard filter array elements 98.

In operation, the system described above may tend to provide a tailored air flow velocity profile around an object to be coated, such as a vehicle 42 driven into booth 20 to sit above pit 166. Arrows 188 represent, in a general sense, air flow paths adjacent to the object to be coated (vehicle 42, for example), with the portions of the flow adjacent to the object tending to become attached (in the fluid flow sense) to the contour of the object, and thus to yield a relatively high velocity stream in a boundary region about vehicle 42. (Arrows 188 are only shown in half of booth 20 of FIG. 2, the other half being taken as being substantially symmetrical). For example, the magnitude of the mean velocity of the air stream in the region from the surface of the object to a distance 6 inches to 12 inches away from the object may tend to exceed the magnitude of the velocity of the air flow 24 to 48 inches from the object. Similarly, the airflow adjacent side walls 36, 38 of the structure 22 may have a mean local magnitude that is higher adjacent that wall (in the range of 0 to 6 inches or a foot) that may tend to be higher than the mean velocity 36 to 48 inches from the wall). In such a situation, establishing suction at pit 166, (i.e., a pressure sink) may tend to delay or discourage, or otherwise tend to lessen or suppress flow separation about the object to be coated. Put differently, drawing off air at the bottom center of booth 20, where there is a gap to permit airflow between the underside of the object to be coated (item 42) and the pressure sink, may tend to encourage the flow to conform, to some extent, to the contour or general shape, of the underside of the vehicle, such that the higher velocity attached flow portion of the airflow may tend to continue downward about the vehicle toward the pressure sink.

The outboard flows may similarly have a tendency to attach to walls 36 and 38. The air flows thus far considered may tend also to urge paint-spray laden air away from lighting assemblies 92 and 94, the airflow streams both inboard and outboard of those assemblies being downward, and away.

Taking the volumetric flowrate through the inboard, or central, filter array 104, as a reference, for every 100 cu. ft. of airflow through central filter array 104, the corresponding airflow through the outboard filter element array 100 (and a like amount through outboard filter array 102) may be in the range of 25 to 75 cu. ft, or in the range of about 50 cu. ft., (+/−10 cu. ft.), with corresponding ratios of flowrates.

The overall filter array flowrates are the product of the flow through a unit of area of the array (be it outboard or inboard) multiplied by the area of the array (be it outboard or inboard). The relative proportions of the flow directed through the outboard filter element arrays 100 and 102, as compared to the central array 104 may be varied by varying the flow resistance (or, inversely, the flow permeability) of the filter elements. This variation may be uniform over one or another of the arrays, or it may be non-uniform, with some regions of filter elements being more resistive than others, and it may be in a pattern e.g., a checkerboard pattern of alternating high resistance and low resistance elements.

Figure 3:
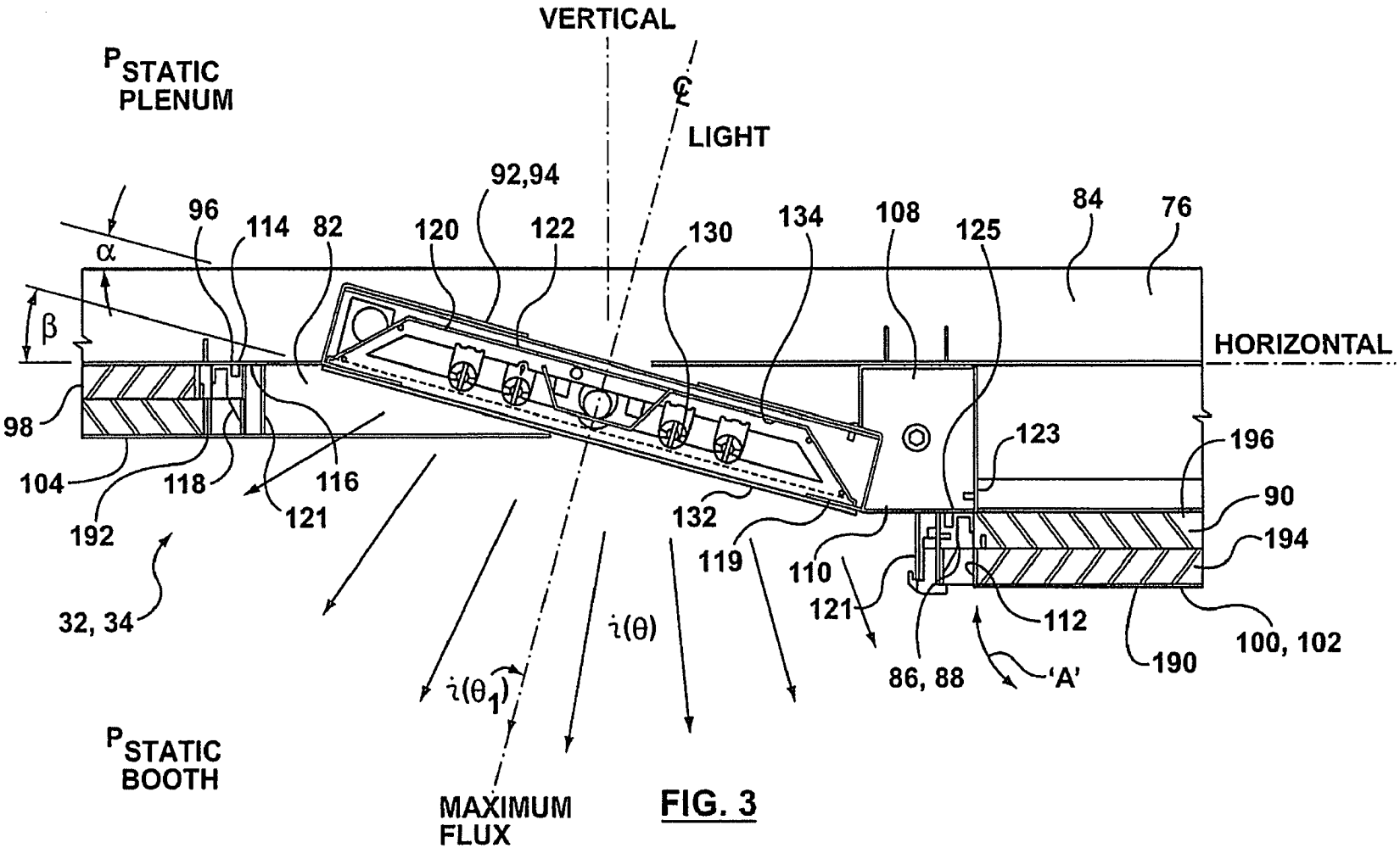
FIG. 3 is a cross-sectional detail, of a ceiling assembly of the spray booth of FIG. 2.

A cross-section of a filter is shown in FIG. 3. The filter element (be it 90 or 98) may include a scrim 190, which may be in the nature of a mesh, be it composite or metal, that extends across, and spans, the framing members of the filter element, indicated generically as 192, and supports the loft 194 and provides a measure of stiffness to the filter. Loft 194 is made of a porous material that permits air to leak through, the flow varying with the pressure differential $\Delta P$ across the filter element.

Loft 194 may be fabricated from a woven polyester material for entrapping dust and other undesirable particulate matter. The loft may be treated with chemical additives that may tend to bond to captured dust and other particles, such that it may tend not to release the particulate matter. The filter medium, (or media) in elements 90 and 98 may be of a fineness to capture particulates of 8 microns or greater in diameter. Particulates above 10 microns in diameter may tend to be visible if captured in the coating.

The resistance (or, alternatively and inversely, permeability) of loft 194 may be altered by increasing the thickness of the layer of lofting material. Alternatively, it may be altered not only by adding another layer of material, but also by employing for that layer (or in yet another additional layer) a low permeability material (or, alternatively put, a high resistance material) that has been knit or otherwise added to the loft. The filter element may thus be divided into distinct zones or strata, the interface between the strata being symbolised by dashed lines. To the extent that array 100 or 102 may have a greater proportion (or lesser proportion) of low permeability material than central filter element array 104, the relative resistance of the arrays may be adjusted to achieve an overall flowrate falling within the ranges notes above. Alternatively, the low permeability material may be mixed in with the more usual material, to give a relatively homogenous matrix of higher than usual resistance to airflow. The difference in specific permeability (that is, the resistance of a unit of area of filter, e.g., 1 sq. ft.) may be such as to reduce the flowrate through the filtering medium (or layers of media, as the case may be) by 30 to 75% or 20 to 60% as compared to a known standard. Alternatively, the scrim may be constructed with a wider mesh or holes in the mesh to lessen the resistance to airflow of the filter element. Another means of varying the resistance of the filter elements is to cover portions of the elements with plates such as may be largely, if not entirely, impervious to the passage of air.

Lighting assemblies 92 and 94 are adapted to provide light in a direction which would, if emitted behind the ceiling, intersect the ceiling at an oblique angle. In other words, the direction along which the greatest light intensity from the lighting assembly is the largest, i.e., the light is the brightest, can be oriented towards the object to be painted; and lighting assemblies 92, 94 are pitched apart by a distance such as may tend to be greater than the width of objects, such as vehicle 42, for which booth 20 is intended. Any lighting assembly that permits its light to be oriented as desired may be used. It may consist of a row of fluorescent light tubes, for example; or an array of incandescent light bulbs. Fluorescent light tubes may be installed in parallel adjacent to backshells 120, and aligned lengthwise relative adjacent to backshells 120, Preferably the light assembly may include a reflector panel or multiple reflectors for better directing the light from the light source.

While two lighting assemblies are shown in FIGS. 1 and 2, it would be understood that it may be feasible to have only one off-set lighting assembly present. Alternatively, it may also be desirable to have more than two lighting assemblies present. For example, a paint spray booth for painting a wide object may have several pairs of lighting assemblies for providing better illumination. For painting objects of varying width, it may be desirable to provide more lighting assemblies at the widest section, for example, near the wings of an airplane, than at relative narrower portions, for example, near the nose section of the fuselage, i.e., body of the airplane.

In an alternative embodiment, the entire lighting assemblies are not turned away from horizontal plane H. Instead, an orientable light reflector may be provided in each lighting assembly. Each light reflector may be oriented, or turned, or angled to direct light in a direction at an oblique angle a relative to the vertical direction V. Light from light sources inside the lighting assembly, as directed by the light reflectors, may be generally aimed in a direction at an oblique angle a relative to the vertical direction V, as if overhead the lighting assembly were oriented at the oblique angle a relative to the horizontal plane H.

Alternatively, side light panels 198 may be provided on side walls 36, 38. A single side lighting assembly 198 may be provided near the central area of side walls 36, for example, under plenum centre beam 84. For better lighting, more side lighting assemblies 198 may be provided on either or both sides of plenum centre beam 84, depending on the length of the object to be painted. These side lighting assemblies 198 may have a similar construction to that of overhead lighting assemblies 92, 94. They may be placed vertically, i.e., with their long sides aligned in a vertical direction. They may be conveniently positioned at a height generally slightly higher than vehicle 42 to be painted. Typically, the bottom edge of side lighting assembly may be is at least 18 in. above the floor. Multiple rows of side lighting assemblies 198 at different heights may also be provided.

Spray booth 20 may alternately be configured for cross-flow or semi cross flow ventilation. Ventilation system 140 may be configured to include inlet venting introduced in an upper region of one end wall, and outlet ducting mounted in either a lower region of the other end wall or in a region of the base adjacent the other end wall. Similarly, ventilation system 140 may be configured to include inlet venting introduced to an upper region of one side wall, and outlet venting along a lower region of the other side wall, or in the base adjacent the other side wall.

Although a complete booth is shown in FIG. 1, an orientable light source with suitable support structure for attaching the light source to an existing spray booth may be used. For example, overhead light panels with hangers 108 (or similar structure), may be used to retrofit an existing spray booth. Further, roof structure 28 or the ceiling assembly 76 portion of structure 28, as described above, may also be used as a stand-alone component for use with an existing spray booth. In other words, roof structure 28 may be retrofit onto a spray booth having an existing wall section and a roof.

In another embodiment, there may be a rear opening in rear wall 34 that may include doors such as doors 44 of front wall 32. This may then provide a tunnel spray structure that may be suitable for production line applications. Vehicles to be spray painted may enter spray booth 20 from one end and exit through the opening at the other end after having been spray-painted inside the spray chamber 30. The tunnel spray structure may have a length to accommodate a plurality of vehicles.

Although FIG. 1 shows an embodiment that provides downdraft airflow in spray booth 20, this lighting arrangement may also be used with spray booths with cross drafts. In an alternative embodiment, a plenum is mounted on one side wall 36 and air exhaust occurs at the opposite side wall 38. Air is forced flowing across the spray chamber 30 and around a vehicle, such as vehicle 42.

In another alternative, spray booth 20 may be a preparation station in which those portions of one, two, or all of walls 32, 36, 38 lying at a level below the level of the filter elements may be a curtain (or curtains) such as may be mounted on an overhead track mounted peripherally about ceiling assembly 76. A downward airflow adjacent to such a curtain may tend to attach in the fluid flow sense to that surface. In such an alternative rear wall 34 may have substantial structure to permit the elements of ceiling assembly 76 to be cantilevered from rear wall 34. Ventilation system 140 may be adjusted to maintain a slight positive pressure inside the curtain.

It may be noted that although ventilation system 140 may be mounted to feed inlet plenum 154 from the side (through cut out 52 of wall 36, for example), it may also be mounted to feed plenum 154 from the end, through a cut-out similar to cut out 52 formed in the region of the upper margin of end wall 34.

Various embodiments of the invention have now been described in detail. Since changes in and or additions to the above-described best mode may be made without departing from the nature, spirit or scope of the invention, the invention is not to be limited to those details but only by the appended claims.

We claim:

1. A spray booth comprising walls and a ceiling extending therebetween, the spray booth having lighting apparatus, wherein said lighting apparatus includes at least a first lighting assembly and a second lighting assembly; said first and second lighting assemblies being located adjacent said ceiling and spaced inwardly of said walls; and said lighting assemblies being convergently oriented, wherein said walls include a first wall running more closely adjacent to said first lighting assembly than any other wall, and an opposed second wall running more closely adjacent to said second lighting assembly than any other wall, said spray booth having a ventilation system, wherein said ventilation system includes venting mounted between said first lighting assembly and said first wall.

2. The spray booth of claim 1 wherein said ventilation system includes venting mounted between said second lighting assembly and said second wall.

3. The spray booth of claim 1 wherein said ventilation system includes venting mounted between said first and second lighting assemblies.

4. The spray booth of claim 1 wherein said spray booth has a floor opposed to said ceiling, said walls standing upwardly of said floor, and said ventilation system includes inlet venting nearer to said ceiling than said floor, and outlet venting nearer to said floor than said ceiling.

5. The spray booth of claim 1 wherein said spray booth has a floor opposed to said ceiling, said walls standing upwardly of said floor, and said ventilation system includes outlet venting nearer to said ceiling than said floor, and inlet venting nearer to said floor than said ceiling.

6. A spray booth comprising walls and a ceiling extending therebetween, the spray booth having lighting apparatus, wherein said lighting apparatus includes at least a first lighting assembly and a second lighting assembly, said first and second lighting assemblies being located adjacent said ceiling and spaced inwardly of said walls, said lighting assemblies being convergently oriented, wherein said walls include a first wall running more closely adjacent to said first lighting assembly than any other wall, and an opposed second wall running more closely adjacent to said second lighting assembly than any other wall, said spray booth having a ventilation system, wherein said ventilation system includes inlet venting mounted between said first lighting assembly and said first wall, between said second lighting assembly and said second wall, and between said first lighting assembly and said second lighting assembly, and exhaust venting mounted distant from said ceiling.

7. A spray booth comprising walls and a ceiling extending therebetween, the spray booth having lighting apparatus, wherein said lighting apparatus includes at least a first lighting assembly and a second lighting assembly, said first and second lighting assemblies being located adjacent said ceiling and spaced inwardly of said walls, said lighting assemblies being convergently oriented, said spray booth having a ventilation system operable to urge overspray away from said lighting apparatus.

8. A spray booth comprising walls and a ceiling extending therebetween, the spray booth having lighting apparatus, wherein said lighting apparatus includes at least a first lighting assembly and a second lighting assembly; said first and second lighting assemblies being located adjacent said ceiling and spaced inwardly of said walls; and said lighting assemblies being convergently oriented, said spray booth having a ventilation system, said ventilation system including inlet vents mounted in a straddling arrangement relative to said lighting apparatus, and outlet vents mounted distant from said ceiling, said ventilation system being operable to introduce ventilating gas into said spray booth adjacent said lighting apparatus, and to urge ventilating gas introduced adjacent said lighting apparatus to move toward said outlet vents.

9. The spray booth of claim 7 wherein said ventilation system includes at least one vent mounted between said first and second lighting apparatus.

10. The spray booth of claim 7 wherein said paint spray booth has a central floor region on which to rest objects to be painted, said floor region having a footprint, said footprint having length and a width; said first lighting apparatus has a length oriented to run generally lengthwise relative to said footprint, said second lighting apparatus has a length oriented to run generally lengthwise relative to said footprint.

11. The spray booth of claim 10 wherein said first and second lighting assemblies have respective lengthwise centerlines, said lengthwise centerlines being spaced apart a distance greater than said width of said footprint.

12. The spray booth of claim 10 wherein said first and second lighting assemblies are symmetrically mounted relative to said footprint.

13. Lighting apparatus for a spray booth, the spray booth having walls and a ceiling extending therebetween, wherein said lighting apparatus includes at least a first lighting assembly and a second lighting assembly; said first and second lighting assemblies being located adjacent said ceiling and spaced inwardly of said walls; said lighting assemblies being convergently oriented, wherein, when viewed in a cross-section across the spray booth, said first lighting apparatus emits light at a maximum intensity along a first vector, said second lighting apparatus emits light at a maximum intensity along a second vector, and said first and second vectors intersect.

14. The lighting apparatus of claim 13 wherein the vectors intersect at a height greater than floor level.

* * * * *